US006158372A

United States Patent [19]

Erskine

[11] Patent Number: 6,158,372

[45] Date of Patent: Dec. 12, 2000

[54] BOAT WINDSHIELD SYSTEM MOUNTING

[75] Inventor: Edward Erskine, Benson, N.Y.

[73] Assignee: Nelson A. Taylor Co., Inc., Gloversville, N.Y.

[21] Appl. No.: 09/313,373

[22] Filed: May 18, 1999

[51] Int. Cl.[7] ..... B63B 19/00

[52] U.S. Cl. ..... 114/177; 296/146.15

[58] Field of Search ..... 114/201 R, 201 A, 114/202, 203, 177, 178, 183; 296/146.15; 49/463

[56] References Cited

U.S. PATENT DOCUMENTS 4,295,675 10/1981 Niskin ..... 114/177
4,364,595 12/1982 Morgan et al. ..... 296/146.15

OTHER PUBLICATIONS

Taylor Made Systems 1998 Catalog, cover page and pp. 13 through 16.

Sketch showing conventional standard direct glaze method used by Nelson A. Taylor Co., Inc. (admitted prior art).

*Primary Examiner*—Jesus D. Sotelo
*Attorney, Agent, or Firm*—Nixon & Vanderhye P.C.

[57] ABSTRACT

A glazing material assembly for closing a window, hatch, or windshield opening in a boat is simple and easy to install and does not require the use of chemicals nor have the time delays associated with conventional installation procedures. The glazing material assembly includes a transparent or translucent piece of glass, or other conventional glazing, having a circumferential portion, and first and second opposite faces, and at least one relatively rigid angle (made of aluminum, fiberglass, molded plastic, or the like) connected to the second face and extending adjacent and generally coincident with the circumferential portion. The angle has first and second substantially transverse interior surfaces which cooperate with like surfaces on a boat cabin body defining an opening which the glass assembly closes. The glass may have a substantially polygonal shape having a plurality of sides, and the at least one angle preferably comprises a plurality of angles, one for each of the sides of the polygon shape. The angles are typically affixed (e.g. by welding or adhesive) together to define a substantially unitary piece, with mitred or bent corners. Foam tape and adhesive preferably connect the angles to the glass second face, and a sealant bead (such as silicone or urethane) engages the glass second face adjacent and exterior of the foam tape and extending substantially around the entire periphery of the glass. Blackout may be provided between the sealant bead and the glass to prevent UV degradation of the sealant. During installation another sealant bead is provided between the circumferential edge of the glass and the cabin body.

23 Claims, 3 Drawing Sheets

BOAT WINDSHIELD SYSTEM MOUNTING

BACKGROUND AND SUMMARY OF THE INVENTION

In the manufacture of boats having windows, hatches, or windshields, one manufacturing technique is to glue a piece of transparent glass (or other glazing material) directly onto a boat so that an opening defined in a cabin body is closed by the piece of glass. However, there are a number of drawbacks associated with that procedure. Among the drawbacks are: the need to clean the cabin body surrounding the window with dangerous solvent; the need to out gas during installation; the need to apply two different sealant beads; the need to handle glass with exposed edges which can be dangerous for the workers and/or subjects the glass to damage if impacted; and all of the above are complicated because of the relatively dirty and often cluttered boat building environment.

According to the present invention the problems associated with the technique described above are overcome in a simple manner. By providing a particular integral glass assembly according to the invention, one is able to make the installation process simpler, less dangerous, and much quicker. Utilizing the invention it is possible to eliminate the need to clean with dangerous solvents since a completely clean system is not necessary, and normally a quick wipe off of the surface defining the opening for the glass assembly will suffice. Also, out gassing is not necessary, the circumferential edge of the glass is protected, and there is only a need to supply one bead of sealant during the glass installation procedure.

According to one aspect of the present invention a boat cabin is provided comprising the following components: A boat cabin body defining a window, hatch, or windshield opening including first and second substantially transverse surfaces. A piece of transparent or translucent glazing material (of any conventional type, such as glass, tempered glass, acrylic, polycarbonate, etc., flat or curved) dimensioned to substantially close the opening and having a circumferential portion, and first and second opposite faces. And a mounting structure which holds the glazing material in place substantially closing the opening, the mounting structure comprising: at least one relatively rigid angle connected to the second face and extending adjacent and generally coincident with the circumferential portion, the angle having first and second substantially transverse interior surfaces engaging and connected to the cabin opening-defining first and second substantially transverse surfaces, respectively. The cabin body where the opening is defined typically is of fiberglass, but could be of almost any material including aluminum, wood, molded plastic, or the like.

Typically the at least one angle is connected to the glazing material second face with foam tape and adhesive. A first bead of sealant is disposed between the glazing material second face and the angle adjacent substantially the entire circumferential portion and adjacent the foam tape. A second bead of sealant—applied during installation by the boat manufacturer—is disposed between the cabin body and the glazing material for sealing the glass to the cabin body, typically sealing between the glazing material circumferential portion and the cabin body. The sealant beads may be made of any suitable conventional material, preferably an elastomeric material, with two examples being silicone or urethane. If the sealant is subject to ultraviolet (UV) light degradation, blackout (black paint, or the like) may be provided between the glass second face and the first sealant bead to minimize or prevent UV degradation of the first bead. The black out may also cover the foam tape to obscure it for aesthetic purposes.

Oftentimes the glass will have a substantially polygon shape with a plurality of sides, and the at least angle then comprises a plurality of angles, one for each of the sides of the polygon shape (with or without rounded corners). Each angle is typically dimensioned to have a portion extending outwardly from the glazing material circumferential portion to protect the circumferential portion, and also to enhance ease of handling. A plurality (some or all) of the angles may be fixed together, by welding, adhesive, or the like, to define a substantially unitary structure, with mitred or bent corners. The angles may be made of a wide variety of materials including aluminum, stainless steel, molded fiberglass, or molded substantially rigid plastic, and may be connected to the cabin body first surface with a plurality of screw fasteners, and/or adhesive, or other suitable conventional fastening systems. Each angle may comprise a glazing flange and a mounting flange intersecting the glazing flange, and a groove formed in the mounting flange adjacent the intersection with the glazing flange.

According to another aspect of the invention a glazing material assembly per se for use in a boat is provided. The glazing material assembly per se comprises the following components: A piece of transparent or translucent glazing material having a circumferential portion, and first and second opposite faces. At least one relatively rigid angle connected to the second face and extending adjacent and generally coincident with the circumferential portion, the angle having first and second substantially transverse interior surfaces. And foam tape and adhesive connecting the at least one angle to the glazing material second face. The details of the glazing material, including the provision of a plurality of angles, a silicone or urethane sealant bead, blackout, etc., may be provided as set forth above.

According to yet another aspect of the present invention a glazing material assembly per se for use in a boat is provided comprising the following components: A piece of transparent or translucent glazing material having a circumferential portion, and first and second opposite faces. At least one relatively rigid angle connected to the second face and extending adjacent and generally coincident with the circumferential portion, the angle having first and second substantially transverse interior surfaces. And a sealant bead engaging the glazing material second face and extending adjacent substantially the entire periphery of the glazing material. The details of the glazing material assembly according to this embodiment are also preferably as set forth above.

According to yet another aspect of the invention there is provided a method of installing a piece of glazing material in an opening in a boat cabin having a boat cabin body defining a window, hatch, or windshield opening including first and second substantially transverse surfaces, using a glazing material assembly comprising: a piece of transparent or translucent glazing material dimensioned to close the opening and having a circumferential portion, and first and second opposite faces; at least one relatively rigid angle connected to the second face and extending adjacent and generally coincident with the circumferential portion, the angle having first and second substantially transverse interior surfaces; and a first sealant bead engaging the glazing material second face and extending adjacent substantially the entire periphery of the glazing material, the method comprising:

(a) without cleaning the boat cabin first and second surfaces with solvent, and without outgassing, placing the first and second interior surfaces of the angle in contact with the first and second surfaces, respectively, of the boat cabin;

(b) attaching the angle to the boat cabin using mechanical fasteners extending between the respective first surfaces so that the glazing material covers the opening; and (c) placing a second sealant bead between the glazing material circumferential portion and the boat cabin to provide a substantially liquid leak-proof seal therebetween ((c) is typically practiced after the glazing area is cleaned, and primed if necessary, in accordance with the sealant manufacturer's recommendations). Many other procedures may also be included in the method depending upon the construction of the glazing material assembly and boat cabin associated therewith.

It is a primary object of the present invention to provide for the simple and effective installation of glazing material in a boat cabin or the like in which there is defined a window, hatch, and/or windshield opening, and to provide a glazing material assembly per se for that purpose. This and other objects of the invention will become clear from an inspection of the detailed description of the invention and from the appended claims.

DETAILED DESCRIPTION OF THE DRAWINGS

Figure 1:
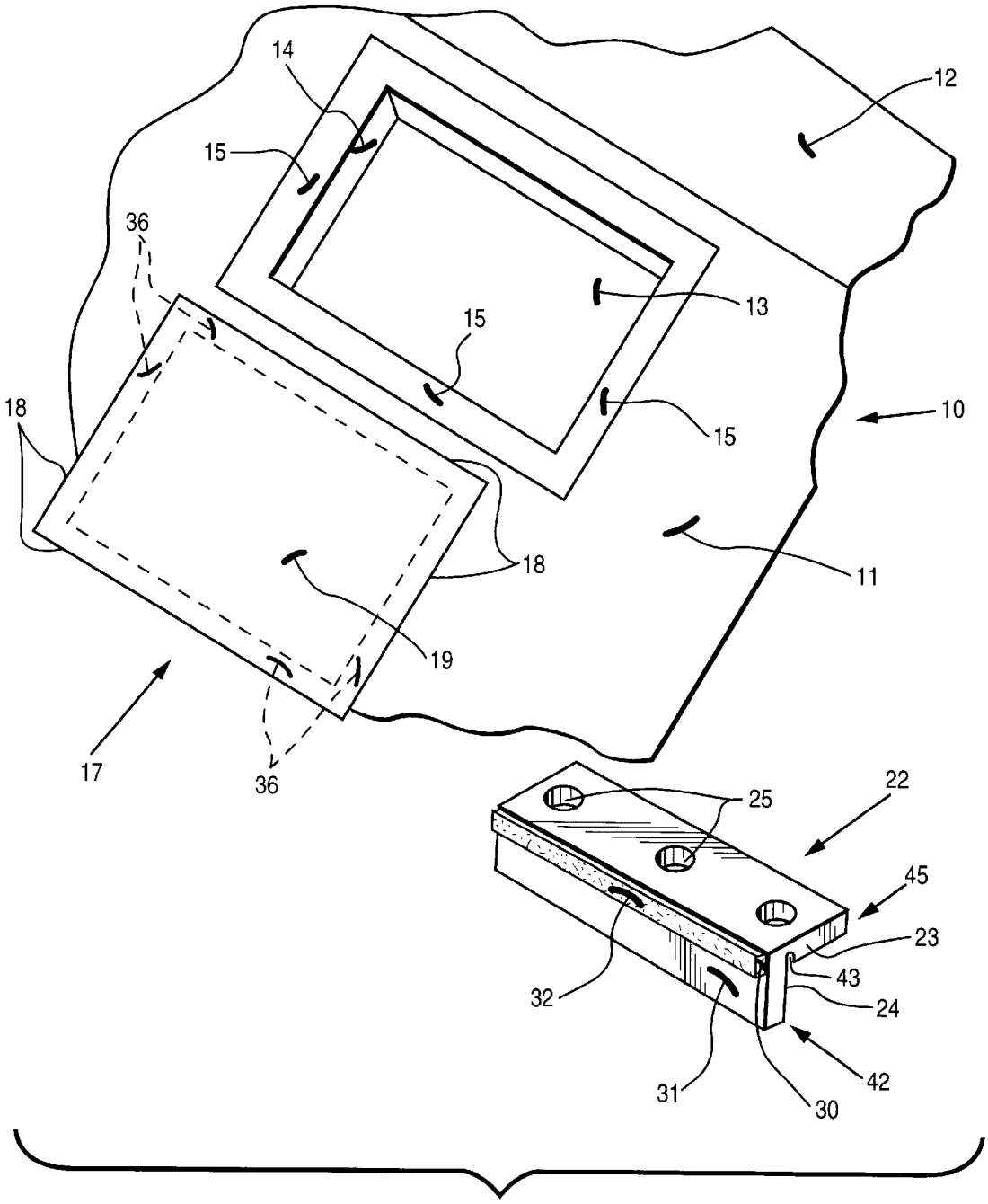
FIG. 1 is a schematic perspective detail view showing a boat cabin having a window, hatch, or windshield opening defined therein, a piece of glazing material for covering that opening, and an angle to be used with the piece of glass to hold it in the opening.

FIG. 1 schematically illustrates one embodiment of a boat cabin utilizing a glazing material assembly according to the present invention in place of a conventional glued in piece of glazing material (of any conventional type, such as glass, tempered glass, acrylic, polycarbonate, etc., flat or curved). A boat cabin of any conventional construction is provided, and is only schematically illustrated at 10 in FIG. 1, and typically has a side wall 11, and a roof, canopy, or top 12 which may be of the same material as the body 11, or a different material. The cabin 10 may be any conventional cabin in which a glued in window, hatch, or windshield system is typically provided, and the cabin 10 may be made of any suitable material, such as fiberglass, aluminum, wood, molded plastic, or the like, fiberglass being the most common material. The cabin body 10 defines one or more openings 13 for a window, hatch, and/or a windshield, the opening 13 (see FIGS. 1 and 2) including first and second substantially transverse surfaces 14, 15, respectively.

The invention further comprises a glazing material assembly per se, and particularly for use in the boat cabin 10. The glazing material assembly per se includes a piece of transparent or translucent glazing material, 17 in FIGS. 1 and 2, dimensioned to substantially close the opening 13 and having a circumferential portion 18 and first and second opposite faces 19, 20. The glazing material 17 may be any conventional type of glazing material that is suitable for use in a boat. A mounting structure holds the glazing material 17 in place substantially closing the opening 13. The mounting structure comprises at least one relatively rigid angle 22, made of any suitable material such as aluminum, stainless steel, molded fiberglass, molded substantially rigid plastic, etc.

Figure 2:
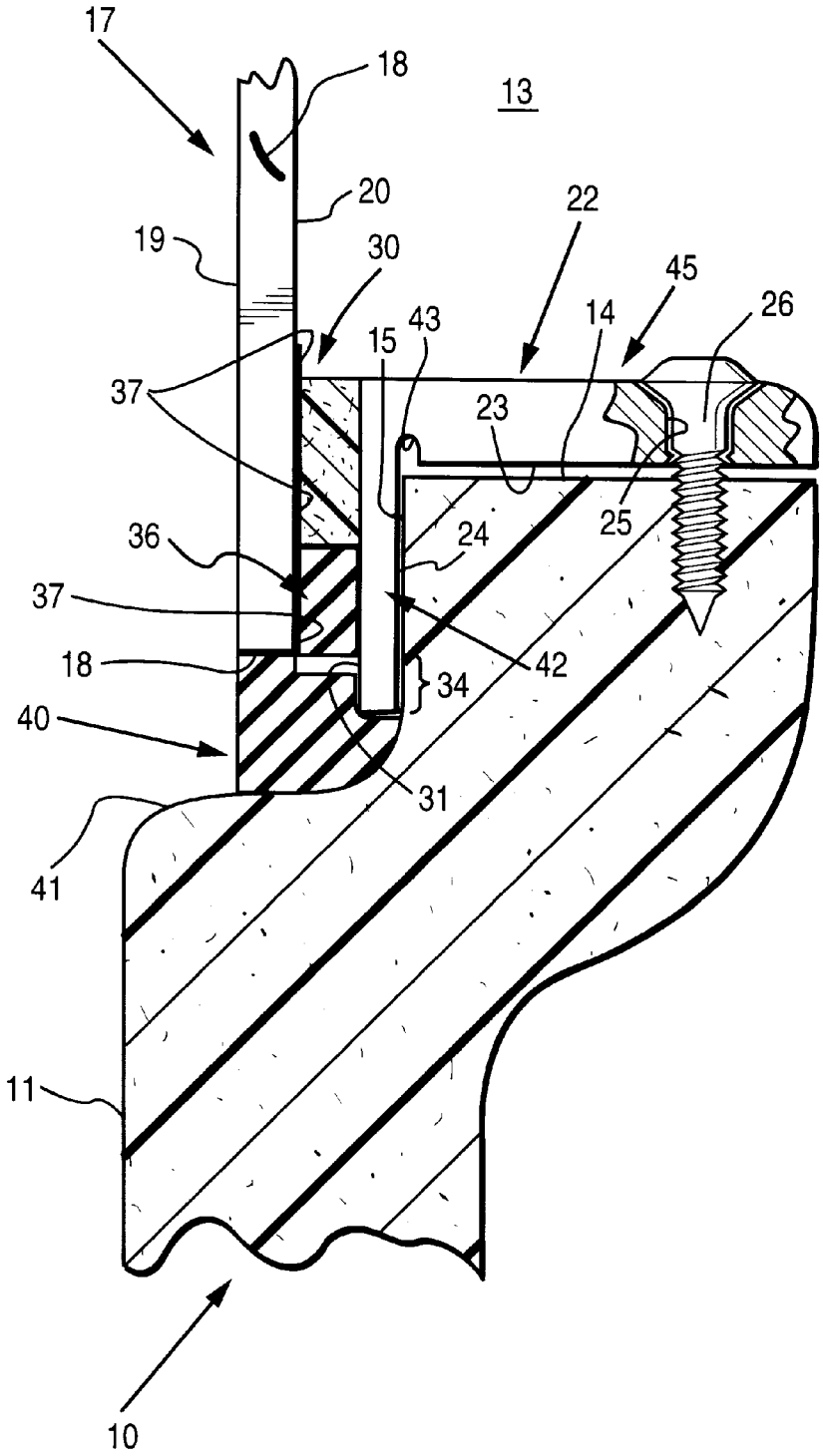
FIG. 2 is a detail side view, partly in cross section and partly in elevation, of the boat cabin of FIG. 1 showing a completely installed glass assembly according to the present invention.

In FIGS. 1 and 2 the angle 22 shown cooperates with the bottom circumferential portion of the glazing material 17 as seen in FIGS. 1 and 2. The angle 22 has first and second substantially transverse interior surfaces 23, 24, respectively, cooperating with the surfaces 14, 15, respectively, to securely mount the glazing material 17 in place. The angle 22 may be connected to the cabin body 10 with any suitable conventional mechanism, such as adhesive, fasteners, or the like. Mechanical fasteners are preferred compared to adhesive. For example, a plurality of openings 25 may be provided in that section of the angle 22 defining the first interior surface 23, and screw fasteners—such as the screw fastener 26 illustrated in FIG. 2—may pass through the openings 25 and be screw threaded into the cabin 10 body, again as illustrated in FIG. 2.

Figure 4:
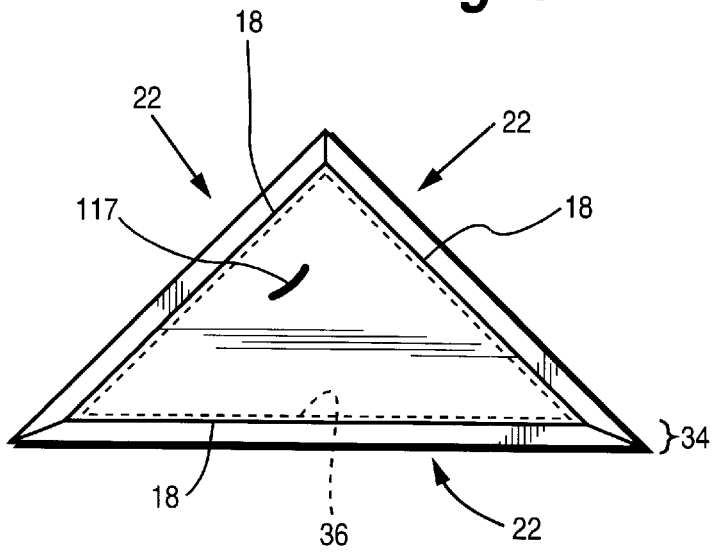
FIG. 4 is a bottom plan view of the glass assembly according to the invention showing the plurality of angles associated therewith.
Figure 5:
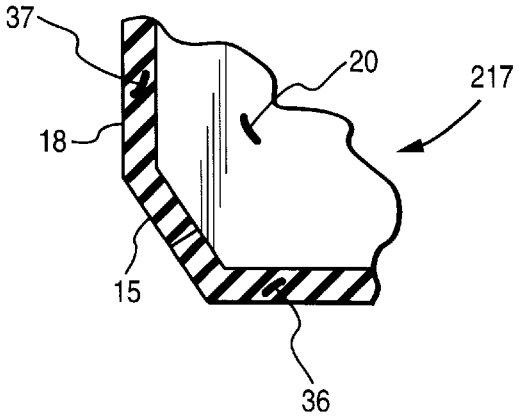
FIG. 5 is a detail plan view of a second face of a piece of glass for use in accordance with the present invention showing the application of blackout under the sealant bead associated therewith.

It is possible, where the angle 22 is made of a suitable material and technique, to install a circular piece of glazing material 17, or an odd-shaped piece of glazing material 17, however in the embodiment illustrated in the drawings the piece of glazing material 17 is quadrate (square or rectangular) as illustrated in FIG. 1, or has some other polygon shape, such as the triangle illustrated in FIG. 4 or the hexagon illustrated in FIG. 5. A substantially polygon shaped piece of glazing material 17 has a plurality of sides, indicated by the four circumferential portions 18 in the embodiment illustrated in FIGS. 1 and 2, and the corners may or may not be rounded.

Figure 3:
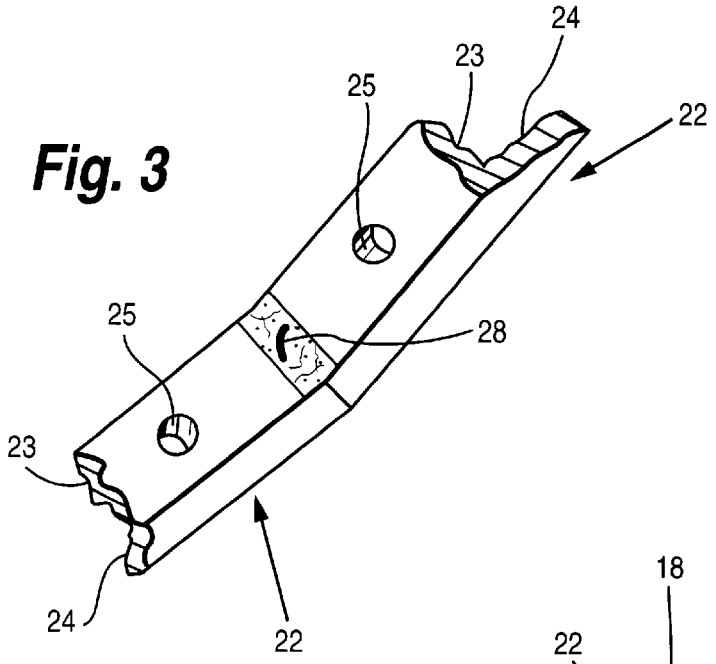
FIG. 3 is a top perspective detail view showing simply two of a plurality of angles that may be utilized for an installation of glass in the boat cabin of FIG. 1.

Preferably the at least one angle 22 comprises a plurality of angles, one for each of the sides (18) of the polygon shape. For example, FIG. 3 shows two of the angles 22 per se for the embodiment of FIGS. 1 and 2, with the glazing material and other components removed for clarity of illustration. Preferably at least some, and desirably, all of the angles 22 are affixed together to define a substantially unitary piece. For example, as illustrated in FIG. 1, the angles 22 may be affixed together at end edges thereof by a weld 28 (such as a metal or ultrasonic weld depending upon the materials of which the angles 22 are made), FIG. 3 illustrating the angles 22 being held together at a substantially right angle with respect to each other, with mitred corners, to mount the rectangular piece of glazing material 17 in the FIGS. 1 and 2 embodiment. Of course, the angle between the angles 22 will depend upon the shape of the piece of glazing material 17.

The angles 22 are connected to the second face 20 of the piece of glazing material 17. While a wide variety of conventional mechanisms may be used for this purpose, in the preferred embodiment illustrated the connection is provided by a piece of foam tape 30 (see FIGS. 1 and 2) connected to the outer surface 31 of that portion of the angle 22 defining the second interior surface 24, and extending outwardly therefrom. In turn the foam tape 30 is connected to the surface 31 and the glass second surface with any adhesive that it is capable of substantially permanently adhering to both of the surfaces 20, 31. For example, the foam tape 30 may comprise a conventional double faced adhesive piece of foam tape, with aggressive adhesive, such as structural glazing tape like that commercially available as Norton V-2200. Adhesive is difficult to illustrate in the drawings, and only one of the adhesive layers is shown schematically at 32 in FIG. 1, that being the adhesive layer 32 which adheres to the face 20.

FIG. 4 schematically illustrates a plurality of angles 22—in this case three angles 22 since the piece of glazing material 117 with which they are associated is triangular—mounted to the glazing material 117. Note that each of the angles 22 has a portion 34 (also see FIG. 2) extending outwardly from the circumferential portion/edge 18 of the piece of glazing material 17, 117. This outwardly extending portion 34 protects the piece of glazing material 17 during installation and handling, and makes it easier to install since the angles 22 themselves may be readily grasped during the installation procedure.

The glazing material assembly according to the present invention also preferably includes a first bead of sealant which engages the second face 20. The first bead of sealant is shown schematically in FIGS. 1 and 2 by reference numeral 36, being shown from the first face 19 of the glazing material 17 in FIG. 1, and therefore being shown in dotted line therein. The sealant 36 is preferably adjacent the circumferential portions 18 and extends around substantially the entire circumferential periphery (the circumferential portion 18) of the piece of glazing material 17. Also, it preferably is adjacent the foam tape 30 as seen in FIG. 2.

The sealant 36 may be of any suitable material that is capable of sealing the glazing material 17 to a surface 31 of the angle 22, as seen in FIG. 2, and preferably is an elastomeric material such as silicone (e.g. GE 2803) or urethane. If the sealant material 36 is subject to UV degradation, then blackout is preferably provided between the face 20 and the sealant 36. The blackout may be black paint or any other suitable material that blocks light so as to minimize or prevent UV degradation of the sealant bead 36. FIG. 2 illustrates this blackout at 37. However, since blackout is difficult to illustrate, FIG. 5 is provided in which the blackout 37 is clearly visible in association with a hexagonal piece of glass 217, the first bead of sealant 36 being cut away in part in FIG. 5 to expose the blackout 37. Preferably the blackout also extends past the tape 30, as illustrated in FIG. 2 (but not FIG. 5) so that the tape 30 is not visible from the face 19 of the glazing 17.

Preferably an integral glazing material assembly is provided which includes a piece of glazing material 17, 117, 217, the foam tape 30 and associated adhesive (e.g. 32), or like conventional component, a plurality of angles 22 connected to the foam tape 30 and to each other (e.g. by welds 28), and the first bead of sealant 36 (as well as blackout 37 if necessary or desired). This entire assembly is then fit into the opening 13, the screws 26 passing through the openings 25 to secure the surfaces 14, 23 in operative contact with each other and therefore mount the entire assembly in closing the opening 13 as seen in FIG. 2. This installation is extremely simple because the glazing material 17 may be easily handled, with the circumferential portion 18 protected by the outwardly extending portions 34 of the angles 22, and the angled surfaces 23, 24 is merely placed into contact with the surfaces 14, 15, and then the screw fasteners 26 inserted through the openings 25 and screwed into the cabin 10 body. Thus, the cleanliness of the surfaces 14, 15 is not critical, and certainly no solvents need to be utilized.

In order to minimize the effects of irregularities in the construction of the angle 22 on the glazing flange 42 (that portion of the angle 22 having the surface 24—see FIG. 2) during installation, a groove 43 may be formed in the support flange 45 (that portion of the angle 22 having the surface 23—see FIG. 2) adjacent the intersection between the flanges 42, 45, as seen in FIG. 2.

The boat builder will also typically install a second sealant bead—shown schematically at 40 in FIG. 2—disposed between the cabin 10 body (and perhaps angle 22) and the glazing material 17 for sealing the glazing material 17 to the cabin 10 body. Preferably the second sealant bead 40 is between the circumferential portions 18 of the piece of glazing material 17 and appropriate mating surfaces, such as the surface 41, of the cabin 10 body. The bead of sealant 40 preferably extends around the entire circumferential portion 18 of the piece of glazing material 17, and may be any suitable conventional sealant material, such as silicone or urethane.

It will thus be seen that according to the present invention a boat cabin, and a glazing material assembly for use in a boat for covering a window, hatch, or windshield opening, are provided which have significant advantages over conventional constructions. While the invention has been herein shown and described in what is presently conceived to be the most practical and preferred embodiment, it will be apparent to those skilled in the art that many modifications may be made thereof within the scope of the invention, which scope is to be accorded the broadest interpretation of the appended claims so as to encompass all equivalent structures and devices.

What is claimed is:

1. A boat cabin comprising:

a boat cabin body defining at least one of a window, hatch, and windshield opening including first and second substantially transverse surfaces;

a piece of transparent or translucent glazing material dimensioned to substantially close said opening and having a circumferential portion, and first and second opposite faces; and a mounting structure which holds said glazing material in place substantially closing said opening, said mounting structure comprising: at least one relatively rigid angle connected to said second face and extending adjacent and generally coincident with said circumferential portion, said angle having first and second substantially transverse interior surfaces engaging and connected to said cabin opening-defining first and second substantially transverse surfaces, respectively.

2. A boat cabin as recited in claim 1 wherein said at least one angle is connected to said glazing material second face with foam tape and adhesive.

3. A boat cabin as recited in claim 2 further comprising a first bead of sealant disposed between said glazing material second face and said angle adjacent substantially said entire circumferential portion and adjacent said foam tape.

4. A boat cabin as recited in claim 3 further comprising a second bead of sealant disposed between said cabin body and said glazing material for sealing said glazing material to said cabin body.

5. A boat cabin as recited in claim 4 wherein said sealant beads are silicone or urethane, and said second bead of sealant is between said glazing material circumferential portion and said cabin body.

6. A boat cabin as recited in claim 4 wherein said angle is aluminum, stainless steel, molded fiberglass, or molded substantially rigid plastic, and is connected to said cabin body first surface with a plurality of screw fasteners.

7. A boat cabin as recited in claim 4 wherein said glazing material has a substantially polygon shape having a plurality of sides; and wherein said at least one angle comprises a plurality of angles, one for each of said sides of said polygon shape.

8. A boat cabin as recited in claim 7 wherein said plurality of angles are affixed together to define a substantially unitary piece, with mitred corners; and wherein each angle has a glazing flange and a mounting flange intersecting the glazing flange, and a groove formed in said mounting flange adjacent the intersection with said glazing flange.

9. A boat cabin as recited in claim 1 further comprising a first bead of sealant disposed between said glazing material second face and said angle adjacent substantially said entire circumferential portion.

10. A boat cabin as recited in claim 9 further comprising a second bead of sealant disposed between said cabin body and said glazing material for sealing said glazing material to said cabin body.

11. A boat cabin as recited in claim 1 wherein said glazing material has a substantially polygon shape having a plurality of sides; and wherein said at least one angle comprises a plurality of angles, one for each of said sides of said polygon shape; and wherein each angle has a portion extending outwardly from said glazing material circumferential portion to protect said circumferential portion.

12. A boat cabin as recited in claim 11 wherein said plurality of angles are affixed together to define a substantially unitary piece, with mitred corners.

13. A glazing material assembly for use in a boat, comprising:

a piece of transparent or translucent glazing material having a circumferential portion, and first and second opposite faces;

at least one relatively rigid angle connected to said second face and extending adjacent and generally coincident with said circumferential portion, said angle having first and second substantially transverse interior surfaces; and foam tape and adhesive connecting said at least one angle to said glazing material second face.

14. An assembly as recited in claim 13 wherein said glazing material has a substantially polygon shape having a plurality of sides; and wherein said at least one angle comprises a plurality of angles, one for each of said sides of said polygon shape, and wherein each angle has a portion extending outwardly from said glazing material circumferential portion to protect said circumferential portion.

15. An assembly as recited in claim 14 wherein said plurality of angles are affixed together to define a substantially unitary piece and have a plurality of fastener-receiving openings therein, and mitred corners; and wherein each angle has a glazing flange and a mounting flange intersecting the glazing flange, and a groove formed in said mounting flange adjacent the intersection with said glazing flange.

16. An assembly as recited in claim 15 further comprising a silicone or urethane sealant bead engaging said glazing material second face and adjacent and exterior of said foam tape and extending adjacent substantially the entire periphery of said glazing material.

17. An assembly as recited in claim 13 further comprising a sealant bead engaging said glazing material second face and adjacent and exterior of said foam tape and extending adjacent substantially the entire periphery of said glazing material.

18. An assembly as recited in claim 17 further comprising black out provided between said sealant bead and foam tape and said glass second face to minimize or prevent UV degradation of said sealant bead and to obscure said foam tape.

19. A glazing material assembly for use in a boat, comprising:

a piece of transparent or translucent glazing material having a circumferential portion, and first and second opposite faces;

at least one relatively rigid angle connected to said second face and extending adjacent and generally coincident with said circumferential portion, said angle having first and second substantially transverse interior surfaces; and a sealant bead engaging said glazing material second face and extending adjacent substantially the entire periphery of said glazing material.

20. An assembly as recited in claim 19 wherein said glazing material has a substantially polygon shape having a plurality of sides; and wherein said at least one angle comprises a plurality of angles, one for each of said sides of said polygon shape; and wherein each angle has a portion extending outwardly from said glazing material circumferential portion to protect said circumferential portion.

21. An assembly as recited in claim 20 wherein said sealant bead is silicone or urethane; and wherein said plurality of angles are affixed together to define a substantially unitary piece and have a plurality of fastener-receiving openings therein, with mitred corners.

22. An assembly as recited in claim 19 further comprising black out provided between said sealant bead and said glass second face to minimize or prevent UV degradation of said sealant bead.

23. A method of installing a piece of glazing material in an opening in a boat cabin having a boat cabin body defining a window, hatch, or windshield opening including first and second substantially transverse surfaces, using a glazing material assembly comprising: a piece of transparent or translucent glazing material dimensioned to close the opening and having a circumferential portion, and first and second opposite faces; at least one relatively rigid angle connected to the second face and extending adjacent and generally coincident with the circumferential portion, the angle having first and second substantially transverse interior surfaces; and a first sealant bead engaging the glazing material second face and extending adjacent substantially the entire periphery of the glazing material, said method comprising:

(a) without cleaning the boat cabin first and second surfaces with solvent, placing the first and second interior surfaces of the angle in contact with the first and second surfaces, respectively, of the boat cabin;

(b) attaching the angle to the boat cabin using mechanical fasteners extending between the respective first surfaces so that the glass covers the opening; and (c) placing a second sealant bead between the glass circumferential portion and the boat cabin to provide a substantially liquid leak-proof seal therebetween.

* * * * *